US009633764B2

(12) United States Patent
Yukawa et al.

(10) Patent No.: US 9,633,764 B2
(45) Date of Patent: Apr. 25, 2017

(54) CONDUCTING LINE SHIELD STRUCTURE

(71) Applicant: YAZAKI CORPORATION, Tokyo (JP)

(72) Inventors: Jun Yukawa, Susono (JP); Hiroyuki Umehara, Susono (JP); Kouji Nishina, Susono (JP); Makoto Katsumata, Susono (JP); Takuya Sugiyama, Susono (JP); Tsuneyuki Horiike, Susono (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 101 days.

(21) Appl. No.: 13/915,821

(22) Filed: Jun. 12, 2013

(65) Prior Publication Data

US 2013/0269971 A1 Oct. 17, 2013

Related U.S. Application Data

(63) Continuation of application No. PCT/JP2011/080561, filed on Dec. 22, 2011.

(30) Foreign Application Priority Data

Dec. 27, 2010 (JP) ..... 2010-289770

(51) Int. Cl.
*H01B 11/06* (2006.01)
*H01B 11/10* (2006.01)
(Continued)

(52) U.S. Cl.
CPC ..... *H01B 11/105* (2013.01); *H01B 7/04* (2013.01); *H01B 19/00* (2013.01); *H01B 11/1091* (2013.01); *Y10T 29/49117* (2015.01)

(58) Field of Classification Search
CPC ..... H01B 7/0861
(Continued)

(56) References Cited

U.S. PATENT DOCUMENTS 4,737,598 A 4/1988 O'Connor
4,898,640 A * 2/1990 O'Connor ..... 156/204
(Continued)

FOREIGN PATENT DOCUMENTS

CN 201499422 U 6/2010
EP 0015816 A1 9/1980
(Continued)

OTHER PUBLICATIONS

Office Action, Issued by the Japanese Patent Office, Dated Jun. 25, 2014, in counterpart Japanese Application No. 2010-289770.
(Continued)

*Primary Examiner* — Chau N Nguyen
(74) *Attorney, Agent, or Firm* — Sughrue Mion, PLLC

(57) ABSTRACT

A conductive line shield structure includes a first conductive line and a shielding member. The first conductive line includes a conductive part and an insulative part. The shielding member is a sheet including an insulative base material and a metal foil, and is wrapped so as to enclose the first conductive line therein. One side end part of the shielding member overlaps an outside surface of the insulative base material so that one side end part of the insulative base material is in contact with the outside surface of the insulative base material.

9 Claims, 7 Drawing Sheets

(51) Int. Cl.
*H01B 7/04* (2006.01)
*H01B 19/00* (2006.01)

(58) Field of Classification Search
USPC ..... 174/36
See application file for complete search history.

(56) References Cited

U.S. PATENT DOCUMENTS

| | | | | |
|---|---|---|---|---|
| 5,573,857 | A * | 11/1996 | Auger | 428/480 |
| 6,166,326 | A * | 12/2000 | Nakajima | 174/36 |
| 6,259,019 | B1 * | 7/2001 | Damilo | H01B 13/262 174/102 R |
| 6,566,606 | B1 * | 5/2003 | Hazy et al. | H01B 11/1091 174/113 R |
| 6,664,466 | B2 * | 12/2003 | Bailey | 174/36 |
| 7,595,647 | B2 * | 9/2009 | Kroh | A61B 5/0031 174/113 R |
| 7,790,981 | B2 * | 9/2010 | Vaupotic et al. | 174/36 |
| 2001/0045296 | A1 | 11/2001 | Bailey | |

FOREIGN PATENT DOCUMENTS

| | | | |
|---|---|---|---|
| EP | 0301859 | A2 | 2/1989 |
| JP | 63-115297 | U | 7/1988 |
| JP | 10-224943 | A | 8/1998 |
| JP | 3062159 | U | 6/1999 |
| JP | 11-215642 | A | 8/1999 |
| JP | 11-353952 | A | 12/1999 |
| JP | 2006-335395 | A | 12/2006 |
| JP | 2007-311045 | A | 11/2007 |
| JP | 2008-67545 | A | 3/2008 |
| JP | 2008-147476 | A | 6/2008 |

OTHER PUBLICATIONS

International Search Report for PCT/JP2011/080561 dated Mar. 30, 2012 [PCT/ISA/210].

Written Opinion for PCT/JP2011/080561 dated Mar. 30, 2012 [PCT/ISA/237].

Office Action dated Jan. 7, 2015 issued by the State Intellectual Property Office of the People's Republic of China in counterpart Chinese Patent Application No. 201180062916.4.

Office Action dated Sep. 6, 2015 issued by the State Intellectual Property Office of the People's Republic of China in counterpart Chinese Patent Application No. 201180062916.4.

Communication issued Feb. 2, 2016, issued by the State Intellectual Property Office of the People's Republic of China in counterpart Chinese Patent Application No. 201180062916.4.

Office Action dated Jul. 26, 2016, issued by the State Intellectual Property Office of P.R. China in counterpart Chinese Application No. 201180062916.4.

Office Action dated Dec. 23, 2016 issued by the State Intellectual Property Office of P.R. China in counterpart Chinese Patent Application No. 201180062916.4.

* cited by examiner

CONDUCTING LINE SHIELD STRUCTURE

CROSS REFERENCE TO RELATED APPLICATIONS

This application is a continuation of PCT application No. PCT/JP2011/080561, which was filed on Dec. 22, 2011 based on Japanese Patent Application (No. P2010-289770) filed on Dec. 27, 2010, the contents of which are incorporated herein by reference.

BACKGROUND OF THE INVENTION

1. Field of the Invention

The present invention is related to a conducting line shield structure in a wire harness.

2. Description of the Related Art

For example, in electric wires for automobile, a shielded electric wire is cabled in a place susceptible to external electromagnetic noise.

In FIGS. 7A and 7B, a shielded electric wire 1 is configured to include plural insulated core wires 2, a drain wire 3 arranged in the insulated core wires 2, a shield layer 4 with which the insulated core wires 2 and the drain wire 3 are covered, and a sheath 5 provided on the outside of the shield layer 4 (for example, see PTL 1).

The insulated core wire 2 has a conductor 6 and an insulator 7. A bare copper electric wire without an insulator is used in the drain wire 3. The shield layer 4 is made of braid or metal foil and is arranged so as to make contact with the drain wire 3. The sheath 5 is provided by extruding an insulating resin material from an extruder. The distal ends of the insulated core wires 2 are provided with terminal fittings 8 as distal end processing. Also, the distal end of the drain wire 3 is provided with a terminal fitting 9.

CITATION LIST

Patent Literature

[PTL 1] JP-A-2008-67545

SUMMARY OF THE INVENTION

In recent years, a desire to offer an electric wire having a shielding function at low cost grows and because of this, the inventors of the present application review a manufacturing step or a structure of each component, with the result that the inventors found that there was room for cost reduction in the shield layer 4 or excessive quality. Hence, the inventors of the present application considered that an enclosure type shielding member having metal foil and formed in a film shape, a sheet shape or a tape shape was used as a shielding member instead of the shield layer 4.

However, when the insulated core wires 2 and the drain wire 3 were enclosed using the enclosure type shielding member, it was found that the metal foil was exposed from a lateral part of the shielding member and insulation characteristics in this exposed portion reduced.

It is therefore one advantageous aspect of the present invention to provide a conducting line shield structure capable of maintaining a shielding function and also ensuring insulation characteristics and further reducing cost.

According to one advantage of the invention, there is provided a conductive line shield structure, comprising:

a first conductive line including a conductive part and an insulative part; and a shielding member, being a sheet including an insulative base material and a metal foil, and wrapped so as to enclose the first conductive line therein, wherein one side end part of the shielding member overlaps an outside surface of the insulative base material so that one side end part of the insulative base material is in contact with the outside surface of the insulative base material.

The one side end part of the shielding member may be folded inside so that the outside surface of the insulative base material is in contact with an outside surface of the one side end part of the insulative base material.

The insulative base material may extend from end of the metal foil at the one side end part of the shielding member.

The sheet may have a film-shape, a sheet shape or a tape shape.

The conductive line shield structure may further comprise a protecting member, wrapped so as to enclose the shielding member therein, and having a film shape, a sheet shape or a tape shape.

The conductive line shield structure may further comprise at least one of a wear-resistant member, a heat-resistant member and a heat shield member, which are provided in an outside and a predetermined area of the protective member.

A plurality of the first conductive lines may be provided.

The first conductive lines may be twisted.

The he first conductive lines may not be twisted.

A part of the first conductive lines may be twisted and other part of the first conductive lines may not be twisted.

The conductive line shield structure may further comprise a second conductive line, a surface of which being conductive and electrically connected with the metal foil, wherein the shielding member is wrapped so as to enclose the first conductive line and the second conductive line therein.

The shielding member may be wrapped slidably with the first conductive line and the second conductive line.

According to another advantage of the invention, there is provided a method for manufacturing a conductive line shield structure, comprising:

preparing a first conductive line including a conductive part and an insulative part;

preparing a shielding member, which is a sheet including an insulative base material and a metal foil;

wrapping the shielding member around the first conductive member so as to enclose the first conductive line therein, so that one side end part of the shielding member overlaps an outside surface of the insulative base material; and contacting one side end part of the insulative base material with the outside surface of the insulative base material.

According to the invention, the shield structure is implemented using the shielding member for collectively enclosing the plural conducting lines and the conductive member. By forming the shielding member in an enclosure type, use equipment in the case of providing the shielding member can be simplified. Also, the invention relates to the enclosure type shielding member of a state of collectively enclosing the plural conducting lines and the conductive member, and can prevent exposure of aluminum foil from one lateral part.

The invention has effects capable of maintaining a shielding function and also ensuring insulation characteristics and further reducing cost. The invention has an effect capable of improving an electrical insulation function by ensuring the insulation characteristics.

According to the invention, the enclosure type shielding member of a state of collectively enclosing the plural conducting lines and the conductive member is protected by a protective member. This protective member is implemented using the enclosure type protective member for enclosing the enclosure type shielding member. Since the enclosure type protective member is formed in a film shape, a sheet shape or a tape shape, the enclosure type shielding member can be protected in the minimum necessary thickness. According to the invention, a structure of extruding a sheath like a known shielded electric wire is eliminated. Therefore, it becomes unnecessary to fully form a thick-wall protective layer regardless of necessity for protection like the sheath, with the result that cost can be reduced. The invention becomes particularly effective in the invention as claimed in claim 3 described below.

The invention has an effect capable of reducing cost also in the outside of the enclosure type shielding member by using the enclosure type protective member.

According to the invention, excessive quality is prevented by providing the wear-resistant member in only the place in which wear resistance is required. Also, excessive quality is prevented by providing the heat-resistant member in the place in which heat resistance is required. Also, excessive quality is prevented by providing the heat shield member in the place in which heat shield properties are required. Consequently, cost can be reduced. In the invention, it is preferable to form the wear-resistant member, the heat-resistant member or the heat shield member in, for example, a tape shape. Also, it is preferable to form the members in a film shape or a sheet shape.

The invention has an effect capable of preventing excessive quality by providing at least one of the wear-resistant member, the heat-resistant member and the heat shield member in the necessary place. Therefore, there is an effect capable of further reducing cost.

According to the invention, the place unnecessary to twist is not twisted and thereby, excessive quality is prevented and also, manufacture is simplified. Consequently, cost can be reduced.

The invention has an effect capable of further reducing cost since excessive quality is prevented. Also, there is the effect capable of further reducing cost since the invention contributes to simplification of a manufacturing step.

According to the invention, in the case of processing (distal end processing) both distal ends of the plural conducting lines and the conductive member, when one distal end is processed, the enclosure type shielding member is slid to the other distal end side and when the other distal end is processed, the enclosure type shielding member is slid to the one distal end side. According to the invention, as compared with the case of processing each of the distal ends without sliding, the whole length of the enclosure type shielding member can be increased, with the result that a shield range with respect to the plural conducting lines and the conductive member can be expanded.

The invention has an effect capable of improving the shielding function in addition to the effects described above.

DETAILED DESCRIPTION OF THE EXEMPLARY EMBODIMENTS

A shield structure is implemented using a shielding member for collectively enclosing plural conducting lines and a conductive member. An enclosure type shielding member is formed in a structure including metal foil and a resin-made base material and also, one lateral part of the enclosure type shielding member is formed as a base material single part or a folded-back formation part.

Figure 1A:
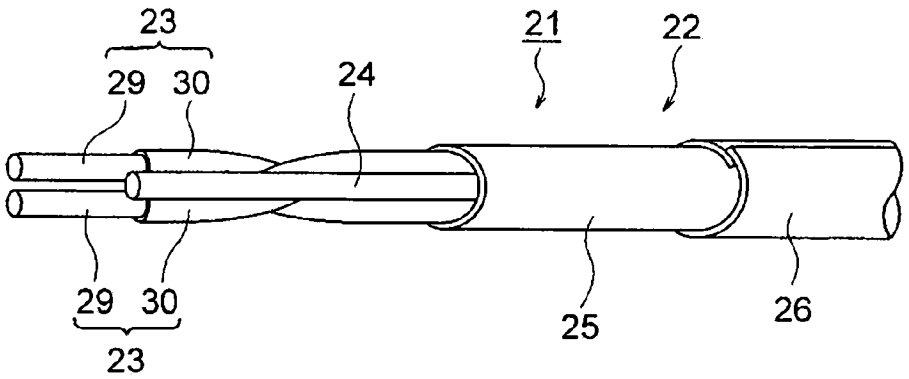
FIG. 1A is a perspective view showing a configuration of the wire harness which adopts a conducting line shield structure according to an embodiment of the invention.
Figure 1B:
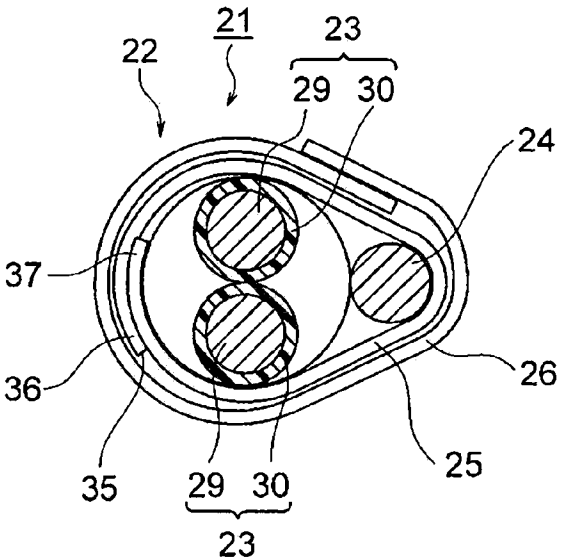
FIG. 1B is a sectional view showing the configuration of the wire harness shown in FIG. 1A.
Figure 2:
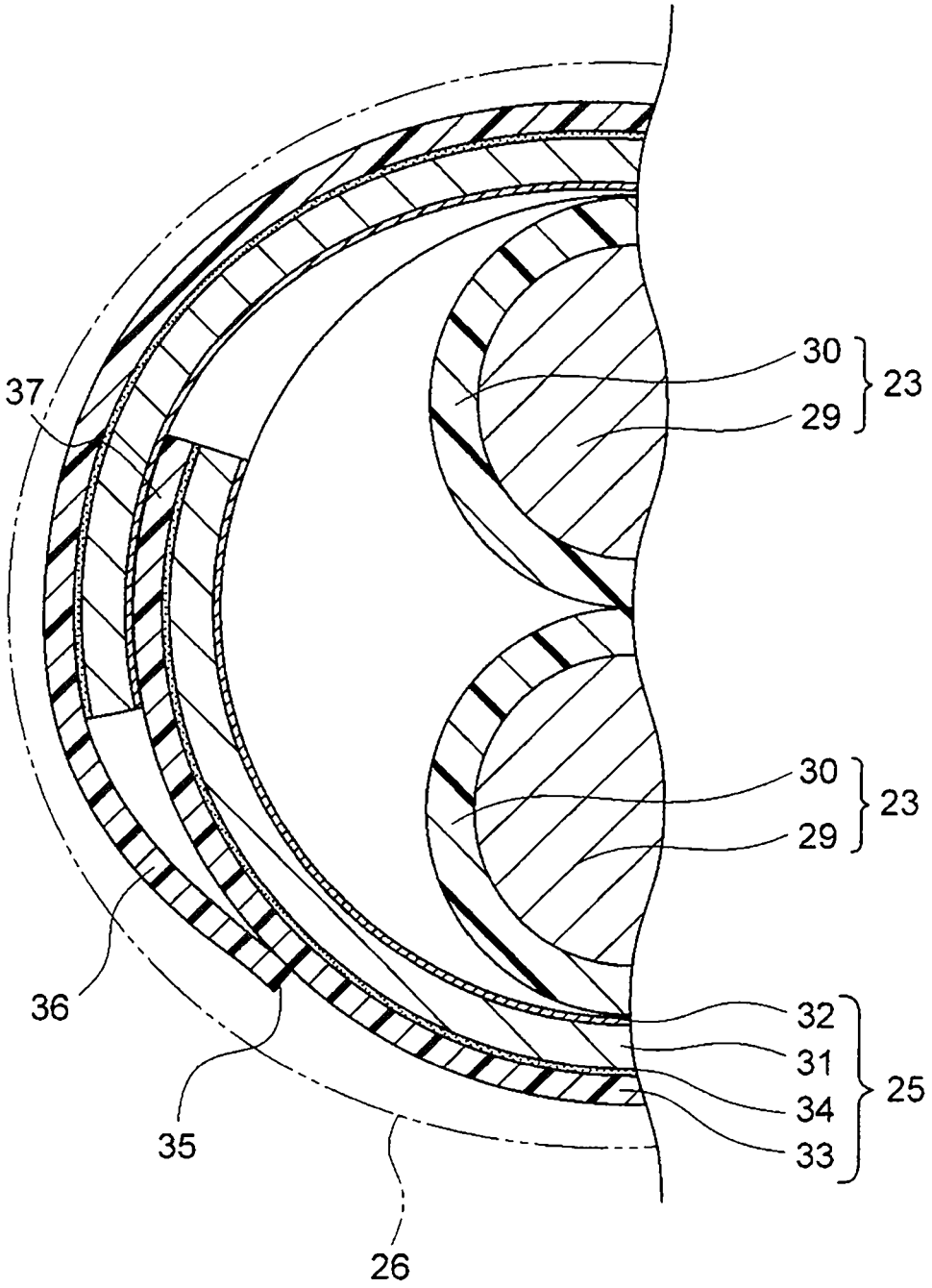
FIG. 2 is an enlarged sectional view showing a first example of a wrapped shield state of mutual lateral parts in the enclosure type shielding member.
Figure 3C:
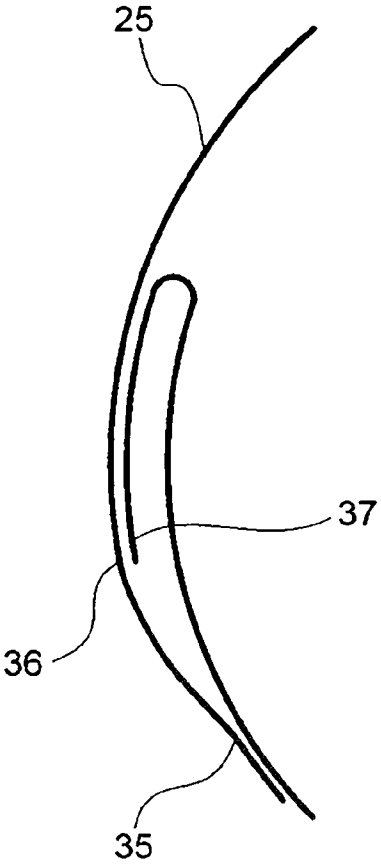
FIG. 3C is a schematic diagram showing a wrapped shield state of a fourth example.

An embodiment will hereinafter be described with reference to the drawings. FIGS. 1A to 1B are diagrams of a wire harness which adopts a conducting line shield structure of the invention. Also, FIGS. 2 to 3C are diagrams showing a wrapped shield state of mutual lateral parts in an enclosure type shielding member, and FIGS. 4A to 4E are diagrams related to a manufacturing step of a wire harness body, and FIGS. 5A and 5B are diagrams related to a distal end processing step, and FIGS. 6A to 6D are diagrams related to another example of a manufacturing step.

In FIGS. 1A and 1B, reference numeral 21 shows the wire harness having a shielding function. The wire harness 21 is cabled in the place necessary to fulfill the shielding function in, for example, an automobile. The wire harness 21 is configured to include a wire harness body 22 and publicly known connections (not shown) which are respectively provided on both distal ends of this wire harness body 22 and make electrical connection. The wire harness 21 will hereinafter be described as a low-voltage wire harness, but is not limited to this wire harness. The wire harness 21 can also be applied to a high-voltage wire harness of, for example, a hybrid vehicle or an electric vehicle.

The wire harness body 22 is configured to include a pair of insulated core wires 23 (first conducting lines), a copper electric wire 24 (a second conductive line), an enclosure type shielding member 25 (a shielding member) and an enclosure type protective member 26 (a protective member). Such a wire harness body 22 is provided with at least one of a wear-resistant member 27, a heat-resistant member (not shown) and a heat shield member 28 (see FIG. 5C) as necessary. The wire harness body 22 itself is configured so as to reduce cost. First, each of the components described above will be described. In addition, the wire harness 21 can also applied to a wire harness body including one insulated core wire 23 and a wire harness body including one insulated core wire 23 and the copper electric wire 24.

The insulated core wire 23 is configured to include a conductor 29 (a conductive part) and an insulator 30 (an insulative part) provided on the outside of this conductor 29. The conductor 29 is a conductive metal portion such as copper, copper alloy, aluminum or aluminum alloy, and is formed in the length necessary to cable the wire harness 21. The conductor 29 adopts a conductor structure made by twisting many strands. In addition, the conductor structure may be, for example, a conductor structure forming a round single core (a round bar wire), a conductor structure forming a quadrilateral single core (a quadrilateral bar wire) or a conductor structure forming a bus bar shape. The conductor 29 has merits of being inexpensive and lightweight when this conductor 29 is made of aluminum.

The insulator 30 is a coating on the conductor 29, and is formed by extruding a publicly known resin material having insulation properties.

The insulated core wires 23 are not limited to two cores as shown in the drawings, and the number of insulated core wires 23 may be, for example, seven, or two or more. Also, the insulated core wires 23 are not limited to twisting as shown in the drawings, and may be formed by no twisting or combination of twisting and no twisting (the twisting will be described below). The size of the insulated core wire 23 is selected properly and may be any of the sizes of publicly known thin and thick electric wires.

The copper electric wire 24 is a copper bare wire without other laminated body directly above, and has a function as a drain wire. The copper electric wire 24 is arranged so as to be longitudinally attached to the pair of insulated core wires 23 in a twisted state. Such a copper electric wire 24 is formed in the same length as that of the insulated core wire 23. The size of the copper electric wire 24 is selected properly. It is essential for the copper electric wire 24 to make electrical contact with the enclosure type shielding member 25. In addition, the copper electric wire 24 is not limited to the wire made of copper and the material of the copper electric wire 24 is not particularly limited as long as the material has conductivity.

The enclosure type shielding member 25 is a shielding member for collectively enclosing the pair of insulated core wires 23 and the copper electric wire 24, and is a sheet formed in a film shape, a sheet shape or a tape shape. The enclosure type shielding member 25 is formed so as to become a shielding member of an enclosure type. The enclosure type shielding member 25 is formed so that the pair of insulated core wires 23 and the copper electric wire 24 can be enclosed in a longitudinally attached state in the embodiment. In other words, the enclosure type shielding member 25 is wrapped so as to enclose the insulated core wires 23 and the copper electric wire 24 therein.

Figure 1C:
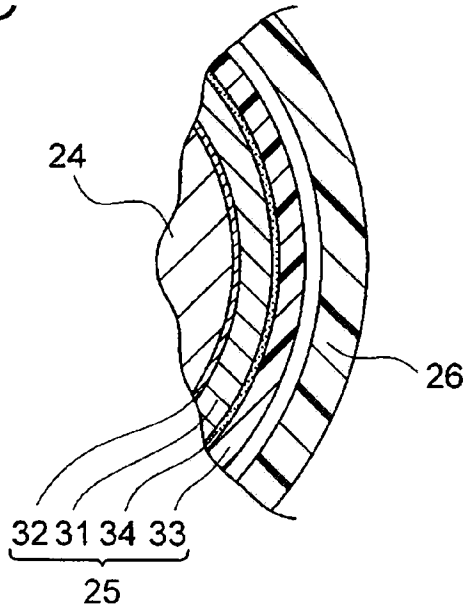
FIG. 1C is an enlarged sectional view showing the portion of contact between a copper electric wire and an enclosure type shielding member of the conducting line shield structure shown in FIG. 1A.

In FIGS. 1 and 2, the enclosure type shielding member 25 is configured to include aluminum foil 31 (metal foil), a plated layer 32 which is provided on one surface of this aluminum foil 31 and makes contact with an outer peripheral surface of the copper electric wire 24, and a resin-made base material 33 which is provided on the other surface side of the aluminum foil 31 and performs insulation. The enclosure type shielding member 25 is formed by a structure of laminating the configuration described above. In addition, the aluminum foil 31 and the base material 33 are integrated by a bonding layer 34, but the integration is not limited to this. That is, they may be integrated by other methods such as vapor deposition.

The plated layer 32 is a layer plated with tin, and is formed on the aluminum foil 31 in a planar state in uniform thickness. By the planar state, there is an effect capable of forming the plated layer 32 evenly uniformly. The plated layer 32 has conductivity and is formed in order to prevent electrolytic corrosion of the copper electric wire 24 and the aluminum foil 31. The plated layer 32 is formed in a thickness of, for example, about 1 μm, but is not particularly limited to this thickness. In addition, the side of the copper electric wire 24 may be given plating. Also, plating may be omitted when metal foil other than the aluminum foil 31 is used.

The aluminum foil 31 is publicly known metal foil made of aluminum, and is formed on the whole surface of the base material 33. A folded-back formation part 38 described below is formed. Or, the aluminum foil 31 is formed so that a base material single part 36 can be obtained in one lateral part 35 of the base material 33. In the embodiment, the latter is adopted. The aluminum foil 31 is formed so that the base material single part 36 can be obtained in one lateral part 35 of the base material 33. The base material single part 36 will be described below. The aluminum foil 31 is formed in a thickness of, for example, about 10 μm, but is not particularly limited to this thickness. In the aluminum foil 31, the length etc. are set according to the place necessary to fulfill the shielding function. As metal foil other than the aluminum foil 31, for example, copper foil is given.

The bonding layer 34 is a layer for bonding the aluminum foil 31 to the base material 33 without peeling and in the embodiment, publicly known glue is used for example.

The base material 33 is a base layer of the enclosure type shielding member 25, and is formed of an insulating material. In the embodiment, a PET (polyethylene terephthalate) sheet is used in the base material 33 for example. In addition to this, for example, a polyester sheet, acetate cloth, polyester cloth, glass cloth, insulating paper, PET fabric or polyester cloth is given. The base material 33 is formed in a thickness of, for example, about 25 μm, but is not particularly limited to this thickness.

One side end part of the enclosure type shielding member 25 overlaps an outside surface of the base material 33 so that one side end part of the base member 33 is in contact with the outside surface of the base material 33.

In a first embodiment of the invention, the base material 33 is formed so that the base material single part 36 can be obtained in one lateral part 35 (the one side end part) of this base material 33 as described above. The base material single part 36 is the portion made of only the base material 33, and is formed so that the other lateral part 37 of the base material 33 can be covered in the case of enclosing the pair of insulated core wires 23 and the copper electric wire 24 (it is enclosed and covered in a sushi roll shape in FIGS. 1A to 2). In other words, the base material 33 extends from end of the metal foil 31 at the one side end part of the enclosure type shielding member 25. The base material single part 36 is formed as an insulating portion for preventing the aluminum foil 31 or the plated layer 32 from being exposed. When the other lateral part 37 of the base material 33 is covered with one lateral part 35 and this forms an overlap portion, a wrapped shield state in which the aluminum foil 31 is wrapped is formed. The overlap portion is only the overlap in the present embodiment, but an inner surface of the base material single part 36 may be fastened to an outside surface of the base material 33 by, for example, thermal welding or thermal fusion. The overlap portion or the fastened portion described above is formed over the whole longitudinal direction of the wire harness 21.

Figure 3B:
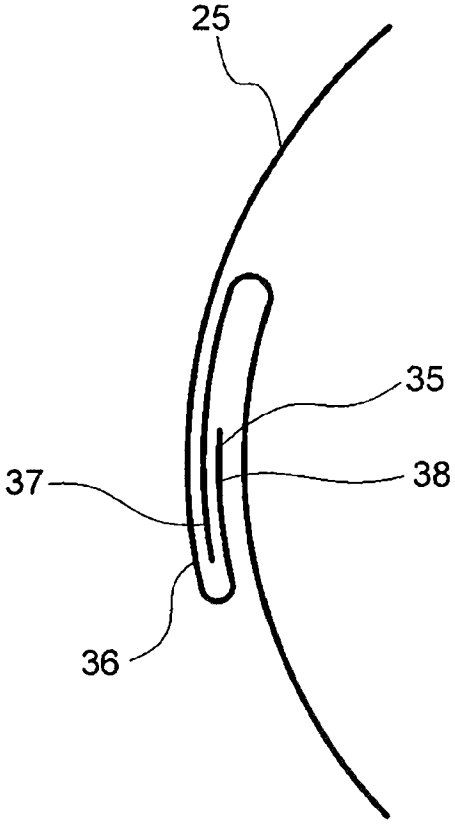
FIG. 3B is a schematic diagram showing a wrapped shield state of a third example.
Figure 3A:
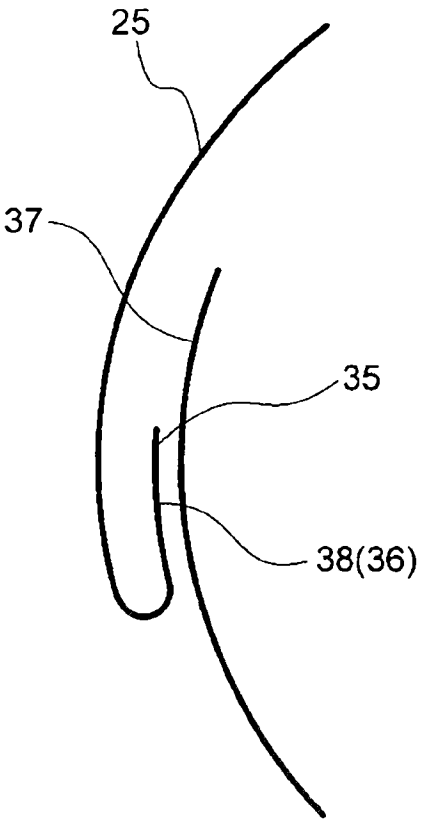
FIG. 3A is a schematic diagram showing a second example of a wrapped shield state of mutual lateral parts in the enclosure type shielding member shown in FIG. 1A.

In a fourth embodiment, one lateral part 35 and the other lateral part 37 of the base material 33 are folded while being overlapped, the aluminum foil 31 or the plated layer 32 can be prevented from being exposed in the case of arranging the base material single part 36 in a position as shown in FIG. 3C. Also, in second and third embodiments in which the base material single part 36 is folded back and the other lateral part 37 is covered as shown in FIGS. 3A and 3B, the aluminum foil 31 or the plated layer 32 can be prevented from being exposed in this case. The base material single part 36 in FIGS. 3A and 3B is also formed as the folded-back formation part 38 capable of folding back this base material single part 36. In addition to this, when the base material single part 36 is not formed, the aluminum foil 31 or the plated layer 32 can be prevented from being exposed in the case of forming the folded-back formation part by overlapping one lateral part 35 and the other lateral part 37 and suppliantly wrapping the lateral parts and then folding back the overlap top inwardly. In other words, in the second to fourth embodiments, the one side end part of the enclosure type shielding member 25 is folded inside so that the outside surface of the base material 33 is in contact with an outside surface of the one side end part of the base member 33.

Returning to FIGS. 1 and 2, the enclosure type protective member 26 is a member for protecting the enclosure type shielding member 25 of a state of collectively enclosing the pair of insulated core wires 23 and the copper electric wire 24, and is formed in a film shape, a sheet shape or a tape shape. The enclosure type protective member 26 is formed so as to be able to protect in the minimum necessary thickness. The enclosure type protective member 26 is formed in the same size as that of the enclosure type shielding member 25 or the size slightly larger than that of the enclosure type shielding member 25. In the embodiment, the enclosure type protective member 26 is formed in the size in which the enclosure type shielding member 25 can be enclosed in a longitudinally attached state. In the embodiment, a PET film made of polyethylene terephthalate is used as the enclosure type protective member 26 (one example is taken). The enclosure type protective member 26 has insulation properties.

The enclosure type protective member 26 is constructed so as to overlap one lateral part and the other lateral part of this enclosure type protective member and then stick the lateral parts with tape. Or, the enclosure type protective member 26 is constructed so as to be fastened by, for example, thermal welding or thermal fusion as necessary. The overlap portion or the fastened portion is formed over the whole longitudinal direction. In addition, an overlap state may be similar to that of the enclosure type shielding member 25. Also, an overlap position is arranged in, for example, the side opposite to an overlap position of the enclosure type shielding member 25, and it is preferable that the overlap positions should differ.

A predetermined position of the outside of the enclosure type protective member 26 is provided with the wear-resistant member 27, the heat-resistant member (not shown) and the heat shield member 28 as shown in FIG. 5. The wear-resistant member 27 is provided in only the place in which wear resistance is required. Adoption of the wear-resistant member 27 has an effect capable of preventing excessive quality and thus reducing cost. On one hand, the heat-resistant member is also provided in the place in which heat resistance is required, and has the effect capable of preventing excessive quality and thus reducing cost like the wear-resistant member 27. On the other hand, the heat shield member 28 is also provided in the place in which heat shield properties are required, and has the effect capable of preventing excessive quality and thus reducing cost like the wear-resistant member 27. It is preferable to form the wear-resistant member 27, the heat-resistant member or the heat shield member 28 in, for example, a tape shape. The shape may be a film shape or a sheet shape. The case of being formed in the tape shape has an advantage capable of adjusting the thickness according to the number of turns. As the wear-resistant member 27, a relatively thick protective member such as publicly known joint tape is given. Also, as the heat-resistant member, a heat-resistant resin mixture is given. Also, as the heat shield member 28, a laminated body of a heat reflective member and a sheet-shaped member is given.

Next, manufacture of the wire harness body 22 and the wire harness 21 will be described based on the configuration and the structure described above.

Figure 4A:
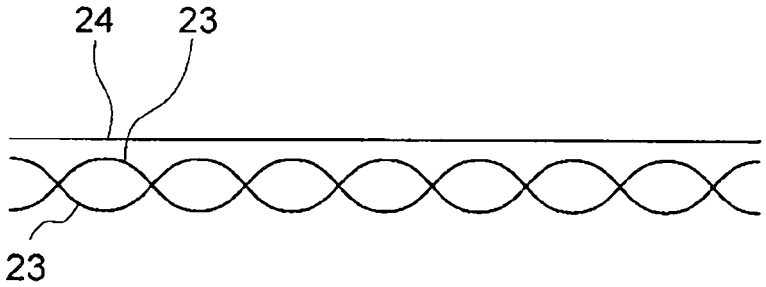
FIGS. 4A to 4E are explanatory diagrams related to a manufacturing step of a wire harness body.
Figure 4B:
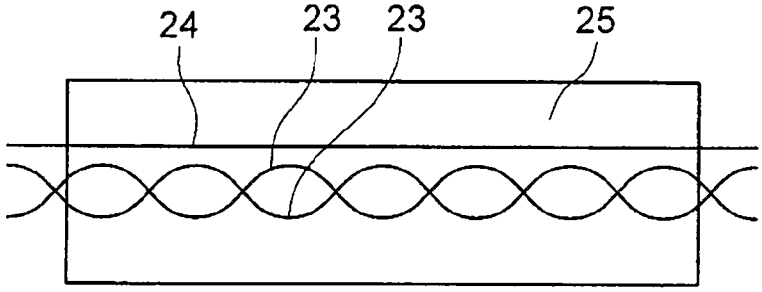
Figure 4C:
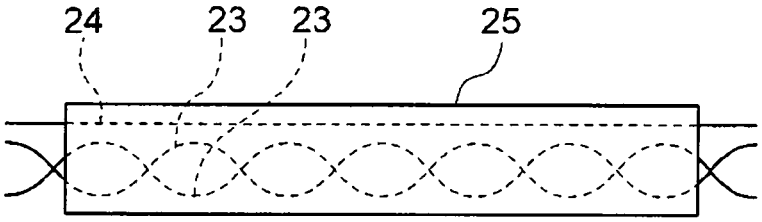
Figure 4D:
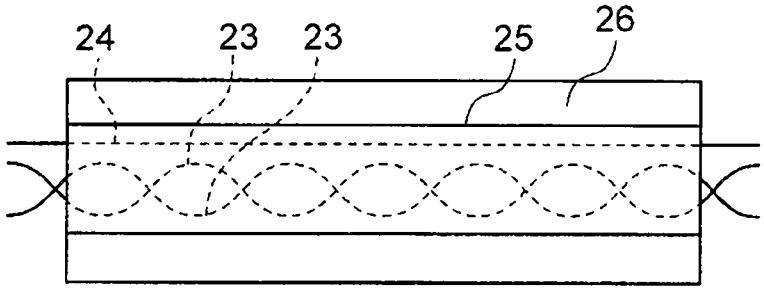
Figure 4E:
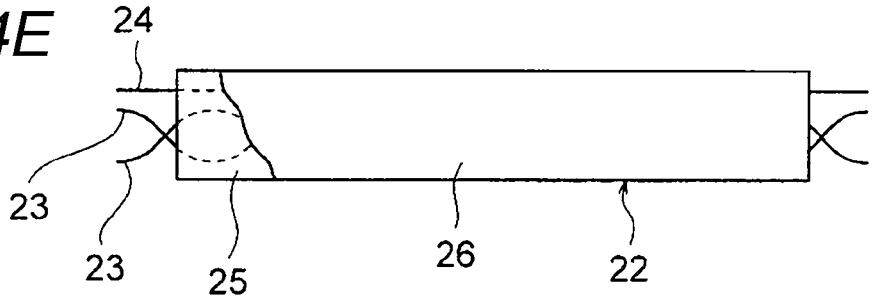
Figure 5A:
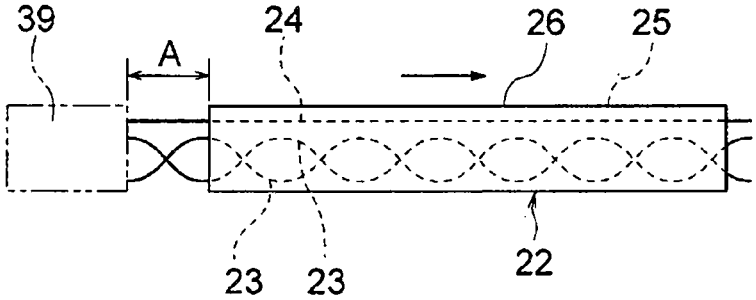
FIGS. 5A and 5B are explanatory diagrams related to a distal end processing step.
Figure 5B:
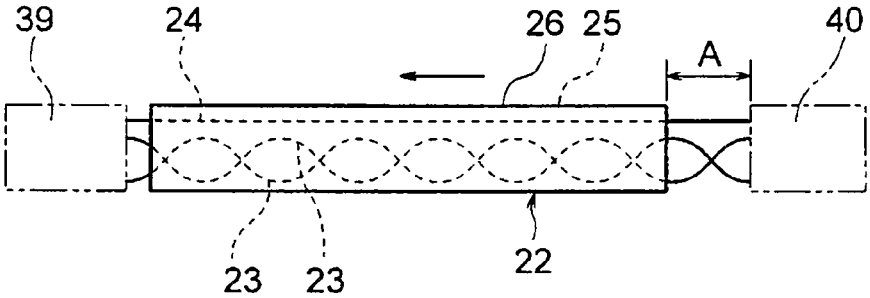

In FIG. 4A, the insulated core wires 23 and the copper electric wire 24 are arranged in a state of attaching the copper electric wire 24 to the pair of insulated core wires 23. Next, the enclosure type shielding member 25 is incorporated so as to enclose the pair of insulated core wires 23 and the copper electric wire 24 as shown in FIGS. 4B and 4C. At this time, the enclosure type shielding member 25 is incorporated so that the inside plated layer 32 of the enclosure type shielding member 25 surely makes contact with the copper electric wire 24. Subsequently, the enclosure type protective member 26 is incorporated so as to further enclose the enclosure type shielding member 25 of a state of collectively enclosing the pair of insulated core wires 23 and the copper electric wire 24 as shown in FIGS. 4D and 4E. The enclosure type protective member 26 may be incorporated so as to make close contact with the enclosure type shielding member 25 or may be incorporated so as to cause a slight gap between the enclosure type shielding member 25 and the enclosure type protective member 26. With the above, manufacture of the wire harness body 22 is completed.

In FIG. 5A, when distal end processing 39 is performed with respect to one distal end of the wire harness body 22, the enclosure type shielding member 25 and the enclosure type protective member 26 are slid to the other distal end side. In the other distal end, the amount of exposure decreases by slide movement of the enclosure type shielding member 25 and the enclosure type protective member 26. Next, when distal end processing 40 is performed with respect to the other distal end of the wire harness body 22, the enclosure type shielding member 25 and the enclosure type protective member 26 are slid to one distal end side as shown in FIG. 5B. In one distal end, the amount of exposure decreases by slide movement of the enclosure type shielding member 25 and the enclosure type protective member 26.

In addition, when the enclosure type shielding member 25 and the enclosure type protective member 26 are not slid, spaces shown by a dimension A are respectively required in both distal ends of the wire harness body 22. On the other hand, the slide movement is adopted in the embodiment, so that a dimension B shorter than the dimension A could be ensured (dimension A>dimension B). Therefore, the whole length of the enclosure type shielding member 25 can be increased, with the result that there is an effect capable of expanding a shield range.

Figure 5C:
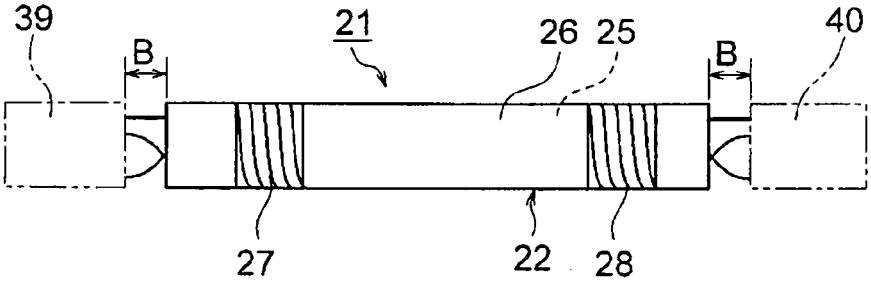
FIG. 5C is an explanatory diagram related to a step of providing a wear-resistant member, a heat-resistant member or a heat shield member.

In FIG. 5C, manufacture of the wire harness 21 is completed when a predetermined position of the outside of the enclosure type protective member 26 is provided with the wear-resistant member 27, the heat-resistant member (not shown) and the heat shield member 28.

Figure 6A:
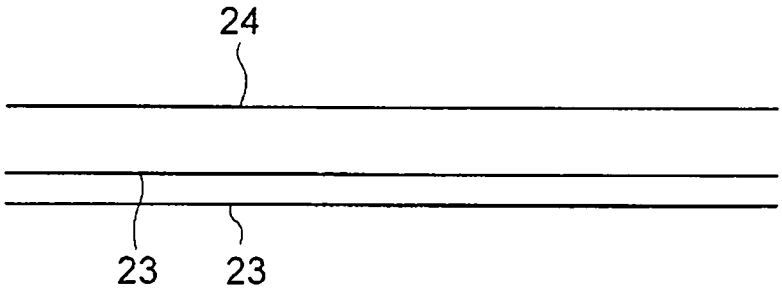
FIGS. 6A and 6B are explanatory diagrams related to a manufacturing step of an example of no twisting of insulated core wires.
Figure 6B:
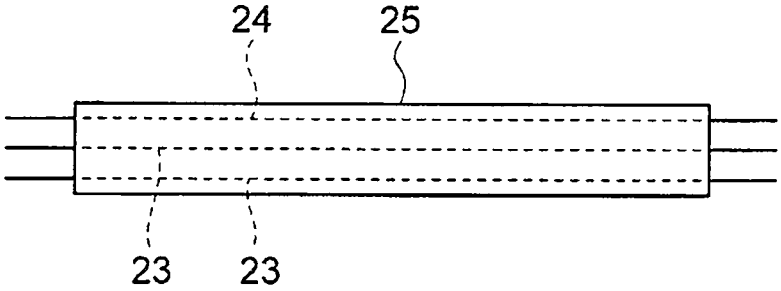
Figure 6C:
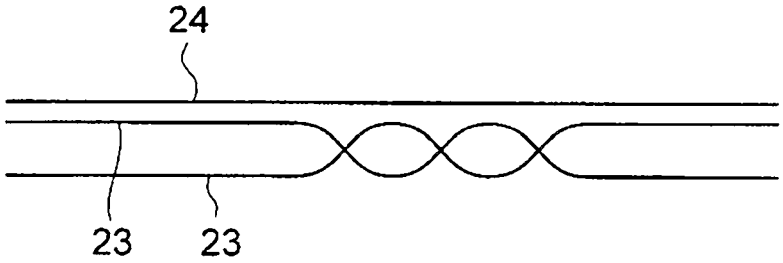
FIGS. 6C and 6D are explanatory diagrams related to a manufacturing step of an example of combination of twisting and no twisting of insulated core wires.
Figure 6D:
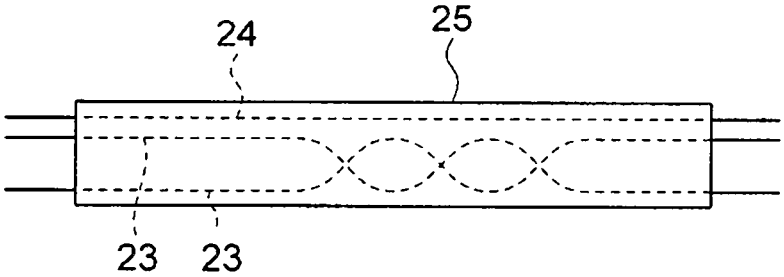
Figure 7A:
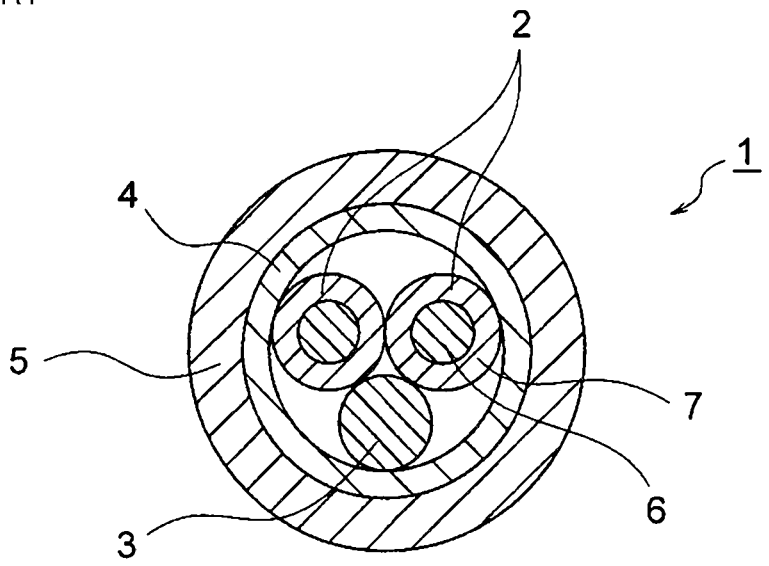
Fig. 7A PRIOR ART
FIG. 7A is a sectional view showing a configuration of the conventional shielded electric wire.
Figure 7B:
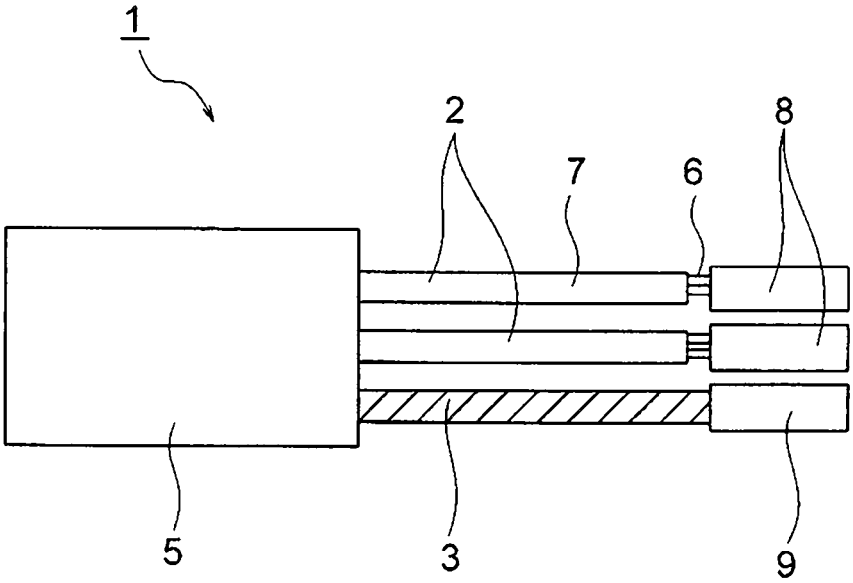
Fig. 7B PRIOR ART
FIG. 7B is a side view showing a distal end portion of the conventional shielded electric wire.

With relation to the manufacture of the wire harness 21, the wire harness 21 may be manufactured by arranging the pair of insulated core wires 23 in substantially parallel (no twisting) without twisting the pair of insulated core wires 23 as shown in FIGS. 6A and 6B. Also, the wire harness 21 may be manufactured by twisting a part of the pair of insulated core wires 23 as shown in FIGS. 6C and 6D. The place unnecessary to twist the insulated core wires is not twisted and thereby, excessive quality is prevented and also, there is an effect capable of simplifying the manufacture and reducing cost.

As described above with reference to FIGS. 1 to 6, the invention has an effect capable of making use equipment simpler than the case of the conventional shield layer by using the enclosure type shielding member 25. Also, the invention relates to the enclosure type shielding member 25 of a state of collectively enclosing the pair of insulated core wires 23 and the copper electric wire 24, and has an effect capable of preventing exposure of the aluminum foil 31 from one lateral part 35 of this enclosure type shielding member 25. Therefore, the invention has effects capable of maintaining the shielding function and also ensuring insulation characteristics and further reducing cost.

In addition to this, the invention has an effect capable of reducing cost also in the outside of the enclosure type shielding member 25 since the enclosure type protective member 26 is used. Also, the invention has an effect capable of further reducing cost since excessive quality is prevented.

In the invention, various changes can naturally be made without departing from the gist of the invention.

The present invention is extremely useful to provide a conducting line shield structure capable of maintaining a shielding function and also ensuring insulation characteristics and further reducing cost.

What is claimed is:

1. A conductive line shield structure, comprising:

a first conductive line including a conductive part and an insulative part;

a shielding member, being a sheet including an insulative base material, an aluminum foil and a plated layer formed on the aluminum foil; and a copper electric wire, a surface of which being conductive and electrically connected with the aluminum foil, wherein the shielding member is wrapped so as to enclose the first conductive line and the copper electric wire therein, wherein a first side end part of the shielding member overlaps an outside surface of the insulative base material so that a first side end part of the insulative base material is in contact with the outside surface of the insulative base material, wherein the insulative base material extends beyond an end of the aluminum foil at the first side end part of the shielding member, wherein the first side end part of the shielding member is folded inside so that the outside surface of the insulative base material is in contact with an outside surface of the first side end part of the insulative base material, wherein the first side end part of the shielding member is comprised only of the insulative base material and does not include the aluminum foil, and wherein a second side end part of the shielding member, which is overlapped by the first side end part of the shielding member, is folded inside so that an inside surface of the first side end part of the insulative base material is in contact with an outside surface of a second side end part of the insulative base material.

2. The conductive line shield structure as set forth in claim 1, wherein the sheet has a film-shape, a sheet shape or a tape shape.

3. The conductive line shield structure as set forth in claim 1, further comprising:

a protecting member, wrapped so as to enclose the shielding member therein, and having a film shape, a sheet shape or a tape shape.

4. The conductive line shield structure as set forth in claim 3, further comprising:

at least one of a wear-resistant member, a heat-resistant member and a heat shield member, which are provided in an outside and a predetermined area of the protective member.

5. The conductive line shield structure as set forth in claim 1, wherein:

a plurality of the first conductive lines are provided, wherein the first conductive lines are twisted.

6. The conductive line shield structure as set forth in claim 1, wherein:

a plurality of the first conductive lines are provided, wherein the first conductive lines are not twisted.

7. The conductive line shield structure as set forth in claim 1, wherein:

a plurality of the first conductive lines are provided, wherein a part of the first conductive lines are twisted and other part of the first conductive lines are not twisted.

8. The conductive line shield structure as set forth in claim 1, wherein the shielding member is wrapped slidably with the first conductive line and the second conductive line.

9. A method for manufacturing a conductive line shield structure, comprising:

preparing a first conductive line including a conductive part and an insulative part;

preparing a shielding member, which is a sheet including an insulative base material, an aluminum foil and a plated layer formed on the aluminum foil;

preparing a copper electric wire, a surface of which being conductive;

wrapping the shielding member around the first conductive member so as to enclose the first conductive line and the copper electric wire therein, so that a first side end part of the shielding member overlaps an outside surface of the insulative base material and that the copper electric wire is electrically connected with the aluminum foil;

inwardly folding the first side end part of the shielding member so that the outside surface of the insulative base material is in contact with an outside surface of the first side end part of the insulative base material; and inwardly folding a second side end part of the shielding member, which is overlapped by the first side end part of the shielding member, so that an inside surface of the first side end part of the insulative base material is in contact with an outside surface of a second side end part of the insulative base material, wherein the insulative base material extends beyond an end of the aluminum foil at the first side end part of the shielding member, and wherein the first side end part of the shielding member is comprised only of the insulative base material and does not include the aluminum foil.

* * * * *